US005952146A

United States Patent [19]

Machino et al.

[11] Patent Number: 5,952,146

[45] Date of Patent: Sep. 14, 1999

[54] COATING LIQUID COMPOSITION FOR PHOTOSENSITIVE MEMBER FOR ELECTROPHOTOGRAPHY AND METHOD OF MANUFACTURING PHOTOSENSITIVE MEMBER FOR ELECTROPHOTOGRAPHY USING SAME

[75] Inventors: Satoshi Machino, Jyoyo; Kazushige Morita, Kitakatsuragi-gun; Kiyofumi Morimoto, Yamatokoriyama; Satoshi Katayama, Nabari; Tomoko Kanazawa, Kashihara; Makoto Kurokawa, Kitakatsuragi-gun, all of Japan

[73] Assignee: Sharp Kabushiki Kaisha, Japan

[21] Appl. No.: 08/994,546

[22] Filed: Dec. 19, 1997

[30] Foreign Application Priority Data

Dec. 26, 1996 [JP] Japan ..... 8-348479

[51] Int. Cl.[6] ..... G03G 5/05

[52] U.S. Cl. ..... 430/134

[58] Field of Search ..... 430/58, 59, 133, 430/134

[56] References Cited

U.S. PATENT DOCUMENTS

| | | | |
|---|---|---|---|
| 4,504,564 | 3/1985 | Pai et al. | 430/132 |
| 4,505,564 | 3/1985 | Nishio et al. | 354/270 |
| 4,925,757 | 5/1990 | Takenouchi et al. | 430/31 |
| 5,334,478 | 8/1994 | Desilets et al. | 430/58 |
| 5,384,222 | 1/1995 | Normandin et al. | 430/58 |
| 5,456,989 | 10/1995 | Nogami et al. | 430/59 |

FOREIGN PATENT DOCUMENTS

| | | |
|---|---|---|
| 0 460 806 A2 | 12/1991 | European Pat. Off. . |
| 2 647 563 A1 | 11/1990 | France . |
| 64-44451 | 2/1989 | Japan . |
| 4-291348 | 10/1992 | Japan . |
| 7-146564 | 6/1995 | Japan . |
| 2 232 778 | 12/1990 | United Kingdom . |

*Primary Examiner*—John Goodrow
*Attorney, Agent, or Firm*—Nixon & Vanderhye

[57] ABSTRACT

An object of the present invention is to improve the storage stability of a coating liquid for forming a photosensitive layer of a photosensitive member for electrophotography as well as to improve the electrophotography properties of a photosensitive member produced by applying the coating liquid. A photosensitive member for electrophotography is produced by applying a coating liquid composition for a photosensitive member for electrophotography prepared by dissolving or dispersing an organic photoconductive compound and a binder resin in a solvent, and further containing an aliphatic unsaturated hydrocarbon on an electroconductive substrate, and drying for forming a photosensitive layer on the electroconductive substrate.

20 Claims, 1 Drawing Sheet

COATING LIQUID COMPOSITION FOR PHOTOSENSITIVE MEMBER FOR ELECTROPHOTOGRAPHY AND METHOD OF MANUFACTURING PHOTOSENSITIVE MEMBER FOR ELECTROPHOTOGRAPHY USING SAME

BACKGROUND OF THE INVENTION

1. Field of the Invention

The present invention relates to a coating liquid composition for a photosensitive member for electrophotography, a method of manufacturing a photosensitive member for electrophotography using the coating liquid composition, and a coating liquid composition for a charge transport layer of a photosensitive member for electrophotography.

More specifically, the invention relates to a coating liquid composition containing an aliphatic unsaturated hydrocarbon, having a significantly improved storage stability.

2. Description of the Relates Art

These days, electrophotography technology is widely used not only in copiers but also in various kinds of printers and facsimiles owing to its immediacy and high image quality. The Carlson method, which is a typical electrophotographic technology, comprises a step of charging the surface of an electrophotography photosensitive member (hereinafter also referred to simply as "a photosensitive member"), a step of forming an electrostatic latent image by exposure, a step of developing the electrostatic latent image with a toner and a step of transferring and fixing the visual image on a paper. As the photosensitive member, inorganic photoconductors, such as selenium, cadmium sulfide, arsenic-selenium alloy, zinc oxide and amorphous silicon have been used conventionally. However, recently many photosensitive members utilizing organic photoconductors, which are not hazardous, and can allow easy film formation and manufacture with a better sensitivity to a light beam in a wide range from 400 to 800 nm compared with inorganic photoconductors, are developed and used.

Among the photosensitive members utilizing the organic photoconductor, a laminated function-separated type photosensitive member where a photosensitive layer is formed with an independent charge generating layer and an independent charge transport layer laminated can provide a highly sensitive photosensitive member by the combination of a charge generating agent and a charge transport agent which are efficient in the use as the charge generating layer and the charge transport layer. Further, since materials can be selected in a broad range for each function, a photosensitive member having an optional characteristic (such as safety and coating property) can be produced comparatively easily at a low cost. For these many advantages, the laminated function-separated type photosensitive member is now the mainstream of the photosensitive member development.

However, laminated function-separated type photosensitive members practically used are inferior to conventional inorganic type photosensitive members in terms of the durability. In particular, the sensitivity is liable to deteriorate due to the deterioration of the electric characteristics such as decline of the charge potential and rise of the residual potential in the repeated use. This is due to deterioration or decomposition of the organic photoconductor compound or the binder resin occurs, or a structural carrier trap formation by the existence of an impurity in the photosensitive layer in the processes of charging, exposing, developing, transferring, and cleaning. Therefore, there are such limitations in terms of the printing durability in the practical use.

The storage stability of a coating liquid for a photosensitive member influences greatly not only the maintenance of the electric characteristics of the photosensitive member applied with the coating liquid but also the productivity or the cost of the photosensitive member. In order to ensure the storage stability, a method of using a charge generating agent or a charge transport agent, which is an organic electroconductive compound, and further, an additive for restraining the decomposition of a binder resin has been commonly adopted so far. For example, a method of adding an antioxidant in a photosensitive layer as disclosed in Japanese Unexamined Patent Publications 64-44451 (1989) and 7-146564 (1995) is well well known.

However, the conventional technology has a setback since the additive used (mainly antioxidant) deteriorates the electric characteristics when it remains in the photosensitive member, or deteriorates the film formation property and the surface property of the photosensitive layer. Accordingly, in order to ensure the stability of the coating liquid for a photosensitive member, it is preferable that such an additive can be eliminated easily in the manufacturing process of the photosensitive member.

SUMMARY OF THE INVENTION

In order to solve the problems, an object of the invention is to provide an additive, capable of improving the stability of a coating liquid for a photosensitive member without remaining.

Another object of the invention is to provide a coating liquid composition for a stabilized photosensitive member applied with an additive which does not remain, having an excellent film formation property.

Still another object of the invention is to provide a method of manufacturing a photosensitive member using the coating liquid composition for a stabilized photosensitive member without generation of an image defect.

A first aspect of the invention is a coating liquid composition for a photosensitive member for electrophotography, comprising an organic photoconductive compound and a binder resin which are dissolved or dispersed in a solvent, containing an aliphatic unsaturated hydrocarbon.

A second aspect of the invention is a coating liquid composition for a photosensitive member for electrophotography where the organic photoconductive compound is a charge generating agent and/or a charge transport agent.

According to the first and second aspects, the storage stability of the coating liquid composition for a laminated function-separated type photosensitive member or a single layer type photosensitive member can be improved by the addition of the aliphatic hydrocarbon.

A third aspect of the invention is a coating liquid composition for a photosensitive member for eletrophotography where the aliphatic unsaturated hydrocarbon has a boiling point in a range from 30 to 120° C.

A fourth aspect of the invention is a coating liquid composition for a photosensitive member for eletrophotography where the aliphatic unsaturated hydrocarbon is a linear or branched-chain hydrocarbon having 5 to 8 carbon atoms.

According to the third and fourth aspects, since an aliphatic unsaturated hydrocarbon having a comparatively low boiling point is added, it can be eliminated easily in the drying process of the photosensitive member. Therefore, the aliphatic hydrocarbon will not remain in the photosensitive member.

A fifth aspect of the invention is a coating liquid composition for a photosensitive member for eletrophotography where the aliphatic unsaturated hydrocarbon in a range from 0.01 to 10 parts by weight to 100 parts by weight of the binder resin is contained in the composition.

According to the fifth aspect, since the content of the aliphatic unsaturated hydrocarbon can be optionally adjusted in the coating liquid for a photosensitive member, the aliphatic unsaturated hydrocarbon can be completely eliminated in the drying process of the photosensitive member so that change in the electric characteristics of the photosensitive member derived from a residual aliphatic unsaturated hydrocarbon, in particular, the residual potential rise is not observed.

A sixth aspect of the invention is a coating liquid composition for a photosensitive member for eletrophotography where the binder resin is a polycarbonate resin.

According to the sixth aspect, the durability and wear resistance of the photosensitive member product can be improved.

A seventh aspect of the invention is a coating liquid composition for a photosensitive member for eletrophotography where the binder resin is a mixture of a polycarbonate resin and a polyester resin.

An eighth aspect of the invention is a coating liquid composition for a photosensitive member for eletrophotography where the binder resin is a mixture of a polycarbonate resin, and a polyester resin and/or a polyarylate resin.

According to the seventh and eighth aspects, the durability and wear resistance of the photosensitive member product can be improved as well as generation of peel-off or crack in the photosensitive layer can be prevented in the manufacturing process of the photosensitive member. Further, adhesion property between the photosensitive layer and the electroconductive substrate can be improved.

A ninth aspect of the invention is a coating liquid composition for a photosensitive member for eletrophotography where the viscosity-average molecular weight of the polycarbonate resin is within a range of 30,000 to 60,000.

A tenth aspect of the invention is a coating liquid composition for a photosensitive member for eletrophotography where the viscosity-average molecular weight of the polyester resin is within a range of 20,000 to 50,000.

An eleventh aspect of the invention is a coating liquid composition for a photosensitive member for eletrophotography where the viscosity-average molecular weight of the polyarylate resin is within a range of 30,000 to 50,000.

According to the ninth to eleventh aspects, since the viscosity-average molecular weight of the binder resin is adjusted in a certain range, the image irregularity or black dots derived from the undissolved matter in the binder resin can be prevented at the time of printing with the photosensitive member product. Furthermore, in the use of the resin mixture, since the viscosity-average molecular weight of each resin component is adjusted, the compatibility of the resin component can be increased.

A twelfth aspect of the invention is a coating liquid composition for a photosensitive member for eletrophotography where the solvent is a hydrocarbon halide.

According to the twelfth aspect, the organic photoconductive compound and the binder resin can be dissolved or dispersed well in the solvent, and the solvent can be eliminated easily in the drying process of the photosensitive member.

A thirteenth aspect of the invention is a method of manufacturing a laminated function-separated type photosensitive member for electrophotography comprising the steps of:

(a) applying a coating liquid for a charge generating layer on an electroconductive substrate, which may have an undercoat layer thereon, for forming a charge generating layer, and (b) applying a coating liquid for a charge transport layer on the charge generating layer for forming a charge transport layer, wherein the coating liquid for a charge generating layer contains a charge generating organic photoconductive compound and a binder resin dispersed in a solvent, and the coating liquid for a charge transport layer contains a charge transport organic photoconductive compound and a binder resin dissolved in a solvent, and further an aliphatic unsaturated hydrocarbon.

According to the thirteenth aspect, a laminated function-separated type photosensitive member for electrophotography having excellent electric characteristics and film formation property of the photosensitive layer can be produced. In printing with the photosensitive member, an image defect will not be generated.

A fourteenth aspect of the invention is a method of manufacturing a laminated function-separated type photosensitive member for electrophotography where the coating liquid for a charge generating layer contains an aliphatic unsaturated hydrocarbon.

According to the fourteenth aspect, the storage stability of the coating liquid for a charge generating layer can be improved by the addition of an aliphatic unsaturated hydrocarbon so that a laminated function-separated type photosensitive member for electrophotography having excellent electric characteristics and film formation property of the photosensitive layer can be produced.

A fifteenth aspect of the invention is a method of manufacturing a laminated function-separated type photosensitive member for electrophotography where the concentration of the binder resin in the coating liquid for a charge generating layer is within a range of 0.1 to 5% by weight.

A sixteenth aspect of the invention is a method of manufacturing a laminated function-separated type photosensitive member for electrophotography where the concentration of the binder resin in the coating liquid for a charge transport layer is within a range of 7 to 13% by weight.

According to the fifteenth and sixteenth aspects of the invention, since the concentration of the binder resin in the coating liquid for a charge generating layer and/or the coating liquid for a charge transport layer is adjusted, the charge generating layer and/or the charge transport layer can be formed on the photosensitive member with a predetermined film thickness.

A seventeenth aspect of the invention is a method of manufacturing a laminated function-separated type photosensitive member for electrophotography further comprising the step of drying the formed charge generating layer and/or charge transport layer at 30 to 120° C. after said step (a) and/or step (b).

According to the seventeenth aspect, the aliphatic unsaturated hydrocarbon and the solvent can be eliminated from the photosensitive member without remaining by drying the photosensitive member at a predetermined temperature after applying the coating liquid in the manufacturing process.

An eighteenth aspect of the invention is a method of manufacturing a single layer type photosensitive member for electrophotography comprising the steps of:

applying a coating liquid for a photosensitive layer on an electroconductive substrate, which may have an undercoat layer thereon, for forming a photosensitive layer, wherein the coating liquid for a photosensitive layer contains a charge generating organic photoconductive compound, a charge transport organic photoconductive compound and a binder resin dissolved or dispersed in a solvent and further an aliphatic unsaturated hydrocarbon.

According to the eighteenth aspect, a single layer type photosensitive member for electrophotography having excellent electric characteristics and film formation property of the photosensitive layer can be produced. In printing with the photosensitive member, an image defect will not be generated.

A nineteenth aspect of the invention is a method of manufacturing a single layer type photosensitive member for electrophotography where the concentration of the binder resin in the coating liquid for a photosensitive layer is within a range of 7 to 13% by weight.

According to the nineteenth aspect, a photosensitive layer can be formed on a photosensitive member with a predetermined film thickness.

A twentieth aspect of the invention is a method of manufacturing a single layer type photosensitive member for electrophotography comprising the step of drying the photosensitive layer at 30 to 120° C. after the step of forming a photosensitive layer.

According to the twentieth aspect, the aliphatic unsaturated hydrocarbon and the solvent can be eliminated in the drying process of the photosensitive member without remaining.

A twenty-first aspect of the invention is a coating liquid composition for a charge transport layer for a photosensitive member for electrophotography containing 5 to 20% by weight of a charge transport layer organic photoconductive compound, 5 to 20% by weight of a binder and a solvent for the remainder, further containing 0.001 to 2% by weight of an aliphatic unsaturated hydrocarbon.

According to the twenty-first aspect, the storage stability can be improved by the addition of an aliphatic unsaturated hydrocarbon to the charge transport layer coating liquid composition, which is liable to deteriorate according to time passage.

A twenty-second aspect of the invention is a coating liquid composition for a charge transport layer for a photosensitive member for electrophotography where the charge transport layer organic photoconductive compound is selected from the group consisting of a hydrazone compound, a styryl compound, and a triphenyl amine compound.

According to the twenty-second aspect, the carrier transport ability of the charge transport layer can be improved by selecting the charge transport organic photoconductive compound from the group.

The present inventors studied a wide range of compounds for the use as an additive in a coating liquid for a photosensitive member for electrophotography to find out that aliphatic unsaturated hydrocarbons contribute to the storage stability of the compound and completed the invention. Further, they found out that aliphatic unsaturated hydrocarbons having 5 to 8 carbon atoms, of a straight chain or a branched chain are particularly effective as an additive in a coating liquid compound. That is, the compound can be stabilized over a long period, the electric characteristics of the photosensitive member applied with the coating liquid compound are stable with little change even after a certain time passage, and further the film formation property and the surface property of the photosensitive layer can be improved. A coating liquid added with an aliphatic unsaturated hydrocarbon is referred to as "a coating liquid compound", but also as "a coating liquid" for convenience herein.

According to the invention, since a certain kind of an unsaturated hydrocarbon is contained in a coating liquid for a laminated function-separated type photosensitive member for electrophotography where a charge generating layer and a charge transport layer are laminated on an electroconductive substrate, or in a coating liquid for a single layer type photosensitive member where a photosensitive layer containing a charge generating agent and a charge transport agent are formed on an electroconductive substrate, the coating liquid for a photosensitive member can be stably stored for a long time, and a photosensitive member produced using thereof has an excellent durability even after a repeated use and stable electric characteristics without decline of the charge potential or rise of the residual potential.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
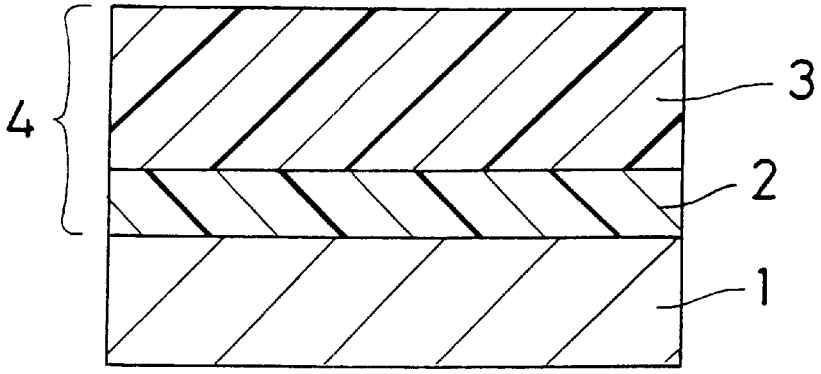
FIG. 1 is a schematic cross-sectional view showing one embodiment of a laminated function-separated type photosensitive member of the invention.

Now referring to the drawings, preferred embodiments of the invention are described below.

FIG. 1 shows one embodiment of a photosensitive member of the invention. The photosensitive member comprises a photosensitive layer 4 on an electroconductive substrate 1. The photosensitive layer 4 comprises a charge generating layer (also referred to as CGL) 2 and a charge transport layer (also referred to as CTL) 3. The photosensitive member in FIG. 1 is a function-separated type photosensitive member where the photosensitive layer 4 comprises two layers, including the charge generating layer 2 and the charge transport layer 3.

Figure 2:
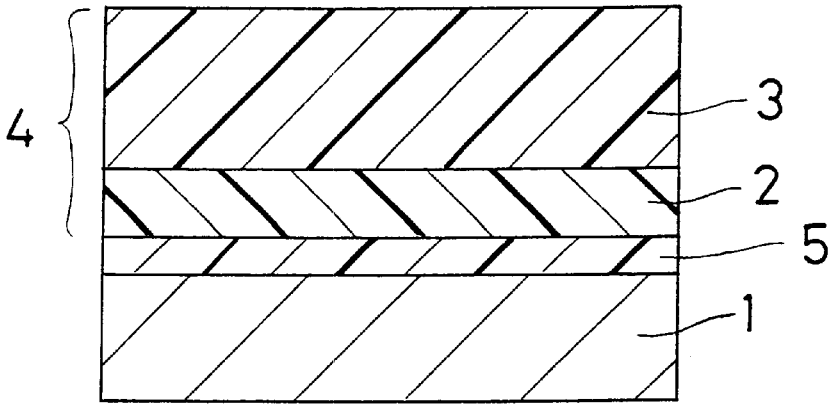
FIG. 2 is a schematic cross-sectional view showing another embodiment of a laminated function-separated type photosensitive member comprising an undercoat layer of the invention.

FIG. 2 shows another embodiment of a photosensitive member of the invention. The photosensitive member comprises an undercoat layer 5 and a photosensitive layer 4 on an electroconductive substrate 1. The photosensitive layer 4 comprises a charge generating layer 2 and a charge transport layer 3. The photosensitive member in FIG. 2 also is a function-separated type photosensitive member where the photosensitive layer 4 comprises two layers, including the charge generating layer 2 and the charge transport layer 3.

Figure 3:
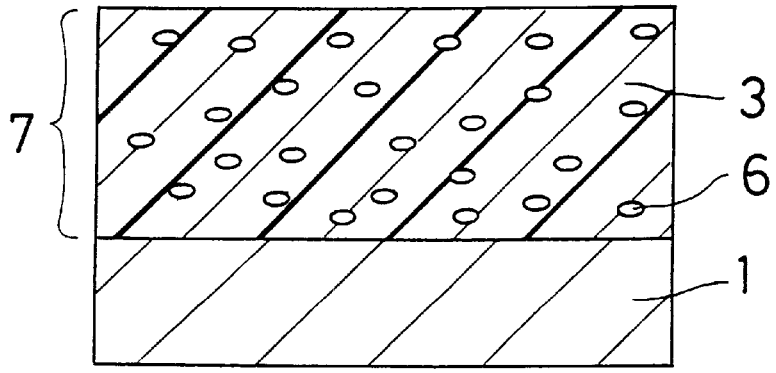
FIG. 3 is a schematic cross-sectional view showing one embodiment of a single layer type photosensitive member of the invention.

FIG. 3 shows a further different embodiment of a photosensitive member of the invention. The photosensitive member comprises a photosensitive layer 7 on an electroconductive substrate 1. The photosensitive layer 7 comprises a charge transport layer 3 and a charge generating material 6. In the photosensitive member of FIG. 3, the photosensitive layer 7 is formed with the charge generating material 6 dispersed in the charge transport layer 3. That is, the photosensitive member of FIG. 3 is a single layer type photosensitive member.

Either of the photosensitive members comprises the photosensitive layer 4 or 7 on the electroconductive substrate 1. Examples of electroconductive substrate to be used include metal materials such as aluminum, stainless steel, copper, and nickel, and insulated substances such as polyester film, phenol resin pipe, and paper tube with a conductive layer such as aluminum, copper, palladium, tin oxide, and indium oxide provided on the surface. The shape of the electroconductive substrate 1 can either be a sheet or a drum.

The charge generating layer 2 contains a known charge generating agent. As a charge generating agent suitable for the invention, inorganic pigments, organic pigments and organic dyes can be used as long as they can generate free charges by absorbing a visual light beam. Examples of inorganic pigments include selenium and alloys thereof, arsenic-selenium, cadmium sulfide, zinc oxide, amorphous silicon and other inorganic photoconductors. Examples of organic pigments include phthalocyanine, azo compounds, quinacridone, polycyclic quinone and perylene. Examples of organic dyes include thiapyrylium salt and squalilium salt.

In addition to the pigments and dyes, the charge generating layer 2 may be added with an electron accepting material such as cyano compounds including tetracyanoethylene and 7,7,8,8-tetracyanoquinodimethane, quinones including anthraquinone and p-benzoquinone, and nitro compounds including 2,4,7-trinitrofluorenone and 2,4,5,7-tetranitrofluorenone as a chemical sensitizer, or pigments including xanthene pigment, thiazine pigment, and triphenyl methane pigment as an optical sensitizer. In the invention, the organic photoconductive compounds such as organic pigments and organic dyes are preferably used.

The charge generating layer 2 is formed by applying a dispersion liquid prepared by dispersing a charge generating agent in an appropriate solvent with a binder resin and optionally added with an aliphatic unsaturated hydrocarbon on an electroconductive substrate 1, and drying or curing for film formation. The film thickness of the charge generating layer 2 is about 0.05 to 5 $\mu$m, and preferably about 0.08 to 1 $\mu$m.

As a method of forming the charge generating layer 2, gas phase deposition methods such as the vacuum deposition method, sputtering, and the CVD, and a method of applying a charge generating agent by pulverizing with a ball mill, a sand grinder, a paint shaker or a supersonic dispersing device, dispersing it in a solvent, optionally adding a binder resin to a sheet-like electroconductive substrate 1 with a baker applicator, a bar coater, casting or spin coat, or to a drum-like electroconductive substrate 1 with the spray method, the vertical ring method or the dip coating method are known.

Concrete examples of binder resins in the invention include polyarylate, polyvinyl butyral, polycarbonate, polyester, polystyrene, poly(vinyl chloride), phenoxy, epoxy, silicone and polyacrylate.

Examples of suitable solvents include hydrocarbon halides such as dichloromethane and 1,2-dichloroethane, ketones such as acetone, methyl ethyl ketone and cyclohexanone, esters such as ethyl acetate and butyl acetate, ethers such as tetrahydrofuran and dioxane, aromatic hydrocarbons such as benzene, toluene and xylene, and non-protonic polar solvents such as N,N-dimethy formamide and dimethyl sulfoxide. Among these examples, hydrocarbon halides are preferably used.

The charge transport layer 3 contains a known charge transport agent. Examples of suitable charge transport agents of the invention include organic photoconductive compounds capable of transporting free charges generated in the charge generating layer 2.

Concrete examples include polymer compounds such as polyvinyl carbazole and polysilane, hydrazone compounds, pyrazoline compounds, oxadiazole compounds, styryl compounds, triphenyl methane compounds, triphenyl amine compounds and enamine compounds. Among these examples, hydrazone compounds, styryl compounds and triphenyl methane compounds are preferable for the excellent charge transport ability.

The charge transport layer 3 is formed by dissolving (or dispersing) a charge transport agent in an appropriate solvent with a binder resin, applying the solution or dispersion added with an aliphatic unsaturated hydrocarbon to an electroconductive substrate 1 with a charge generating layer 2 formed, and drying or curing for film formation. The film thickness of the charge transport layer 3 is about 0.1 to 50 $\mu$m, preferably about 1 to 40 $\mu$m. Therefore, the film thickness of the photosensitive layer 4 comprising the laminated charge generating layer 2 and charge transport layer 3 is about 0.1 to 55 $\mu$m, preferably about 1 to 40 $\mu$m.

As a method of forming the charge transport layer 3, a baker applicator, a bar coater, casting or spin coat is used for a sheet-like electroconductive substrate 1, or the spray method, the vertical ring method or the dip coating method is used for a drum-like electroconductive substrate 1

A binder resin used for the charge transport layer 3 is substantially the same as that for the charge generating layer 2. Examples of the binder resin include polycarbonate, polyarylate, polyether ketone, epoxy, urethane, cellulose ether, and copolymers of a monomer necessary for forming the resins. Among these resins, polycarbonate resin is preferable for the stable electric characteristics, mechanical strength, and the manufacturing cost of the photosensitive member. In particular, polycarbonate resins having the viscosity-average molecular weight of about 30,000 to 60,000, copolymers of a polycarbonate resin or copolymers having a polycarbonate resin and the monomer of the resin as the repeating component are preferable. Further, the polycarbonate may be added with a polyester resin containing an aromatic dicarboxylic acid component represented by polyethylene terephthalate, and a glycol component, or a copolymer such as polyarylate, of a functional monomer containing a functional group such as a carboxyl group and a hydroxyl group and a monomer of the resin. In particular, polyester resins having about 20,000 to 50,000 viscosity-average molecular weight and polyarylate having 30,000 to 50,000 viscosity-average molecular weight are preferable in terms of the electric characteristics and the image property in the repeated use and the maufacturing cost of the photosensitive member.

Polycarbonate resins preferably used in the invention can be synthesized by a known method for the polymerization reaction of divalent phenol and phosgene with the end sealed with a monofunctional compound.

Concrete examples of divalent phenols include 4,4'-(1-methyl ethylidene)bisphenol, 4,4'-(1-methyl ethylidene)bis[2-methyl phenol], 4,4'-cyclohexylidene bisphenol, 4,4'-ethylidene bisphenol, 4,4'-propylidene bisphenol, 4,4'-butylidene bisphenol, 4,4'-(1,3-dimethyl butylidene) bisphenol, 4,4'-(1-methyl ethylidene)bis[2,6-dimethyl phenol], 4,4'-(1-phenyl ethylidene)bisphenol, 4,4'-(2-ethyl hexylidene)bisphenol, 5,5'-(1-methyl ethylidene)[1,1'-biphenyl]-2-ol, [1,1'-biphenyl]-4,4'-diol, 4,4'-methylidene bisphenol, 4,4'-methylene bis[2-(2-propenyl)phenol], 4,4'-methylene bis[2-methyl phenol], 4,4'-(1-methyl propylidene)bisphenol, 4,4'-(2-methyl propylidene) bisphenol, 4,4'-(3-methyl butylidene)bisphenol, 4,4'-cyclopentylidene bisphenol, 4,4'-(phenyl methylidene) bisphenol, 4,4'-(1-methyl heptylidene)bisphenol, 4,4'-cyclohexylidene bis[3-methyl phenol], 4,4'-(1-methylethylidene)bis[2-(2-propenyl)phenol], 4,4'-(1-methyl ethylidene)bis[2-(1-methyl ethyl)phenol], 4,4'-(1-methyl octylidene)bisphenol, 4,4'-(1-phenyl ethylidene)bis[2-methyl phenol], 4,4'-cyclohexylidene bis[2,6-dimethylphenol], 4,4'-(1-methyl)nonylidene bisphenol, 4,4'-decylidene bisphenol, 4,4'-(1-methyl ethylidene)bis[2-(1,1-methyl propyl)phenol], 4,4'-(1-methyl ethylidene)bis[2-(1,1-dimethyl ethyl)phenol], 4,4'-(diphenyl methylidene) bisphenol, 4,4'-cyclohexylidene bis[2-(1,1-dimethyl ethyl) phenol], 4,4'-(2-methyl propylidene)bis[3-methyl-6-(1,1-dimethyl ethyl)phenol], 4,4'-(1-methyl ethylidene)bis[2-cyclohexyl phenol], 4,4'-methylene bis[2,6-bis(1,1-dimethyl ethyl)phenol], 4,4'-methylene bis[2,6-di-sec-butyl phenol], 5,5'-(1,1-cyclohexylidene)bis-(1,1'-biphenyl)-2-ol, 4,4'-cyclohexylidene bis[2-cyclohexyl phenol], 2,2'-methylene bis[4-nonyl phenol], 4,4'-(1-methyl ethylidene)bis[2,6-bis (1,1-dimethyl ethyl)phenol], 5,5'-(1-phenol ethylidene)[1,1'-biphenyl]-2-ol, bis(4-hydroxy phenyl)methanone, 4,4'-methylene bis[2-fluoro phenol], 4,4'-[2,2,2-trifluoro-1-(trifluoro methyl)ethylidene]bisphenol, 4,4'-isopropylidene bis[2-fluorophenol], 4,4'-[(4-fluoro phenyl)methylene]bis[2-fluoro phenol], 4,4'-(phenyl methylene)bis[2-fluoro phenol], 4,4'-[(4-fluoro phenyl)methylene]bisphenol, 4,4'-(1-methyl ethylidene)bis[2-chloro-6-methyl phenol], 4,4'-(1-methyl ethylidene)bis[2,6-dichloro phenol], 4,4'-(1-methyl ethylidene)bis[2-chloro phenol], 4,4'-methylene bis[2,6-dibromophenol], 4,4'-(1-methyl ethylidene)bis[2,6-dibromophenol], 4,4'-(1-methyl ethylidene)bis[2-nitrophenol], 3,3'-dimethyl-[1,1'-biphenyl]-4,4'-diol, 3,3'5,5'-tetramethyl-[1,1'-biphenyl]-4,4'-diol, 3,3'5,5'-tetra-t-butyl-[1,1'-biphenyl]-4,4'-diol, 3,3'-difluoro-[1,1'-biphenyl]-4,4'-diol, and 3,3'5,5'-tetrafluoro-[1,1'-biphenyl]-4,4'-diol. Two or more kinds of these monomers can be used as divalent phenol.

Among the examples of divalent phenols, polycarbonate resins derived from 4,4'-(1-methyl ethylidene)bisphenol, or 4,4'-(1-cyclohexylidene)bisphenol are particularly preferable.

An appropriate solvent for dissolving (or dispersing) a charge transport agent is substantially the same as a solvent for dispersing a charge generating agent and thus can be selected from the examples provided for the charge generating agent. Hydrocarbon halide is a particularly preferable solvent.

In the photosensitive members shown in FIGS. 1 and 2, the photosensitive layer 4 comprises the laminated charge generating layer 2 and charge transport layer 3. By negatively charging the surface of the photosensitive member comprising the photosensitive layer 4 with a charger and irradiating a light beam having an absorption wavelength to the charge generating layer 2, charge carriers of electrons and positive holes are generated in the charge generating layer 2. The positive holes are transferred to the photosensitive member surface by the charge transport agent contained in the charge transport layer 3 so as to neutralize the negative charge on the surface. On the other hand, the electrons in the charge generating layer 2 are transferred to the positively-charged electroconductive substrate 1 side so as to neutralize the positive charge. Accordingly, it is preferable to use the photosensitive member of the invention in the negative charge, however, the photosensitive layer 4 of the invention can function as well in the opposite charge mode, that is, the positive charge.

The photosensitive member of FIG. 2 comprises an undercoat layer 5 between the photosensitive layer 4 and the electroconductove substrate 1. The undercoat layer 5 can be formed from, for example, polyamide, polyurethane, cellulose, nitrocellulose, polyvinyl alcohol, polyvinyl pyrrolidone, or polyacryl amide resin, aluminum anodic oxidization film, gelatin, starch, casein, or N-methoxy methylated nylon. Furthermore, particles of titanium oxide, tin oxide, or aluminum oxide may be further dispersed therein. The film thickness of the undercoat layer 5, which serves as the adhesion layer between the electroconductive substrate 1 and the photosensitive layer 4, is about 0.1 to 10 μm. In addition, in the photosensitive member charge mode, it serves as the barrier for restraining the flow of the charge from the positively-charged electroconductive substrate 1 to the photosensitive layer 4. Accordingly, since the undercoat layer 5 maintains the charge characteristics of the photosensitive member, it ensures a longer life of the photosensitive member.

The photosensitive member shown in FIG. 3 is a single layer type photosensitive member where a single layer of the photosensitive layer 7 is formed by dispersing a charge generating material 6 comprising a charge generating agent in a charge transport layer 3. The formation process of the photosensitive layer 7 is substantially the same as that of the charge generating layer 2 or the charge transport layer 3. That is, it is formed by dissolving or dispersing a charge generating agent and a charge transport agent in an appropriate solvent with a binder resin, applying the dispersion added with an aliphatic unsaturated hydrocarbon to an electroconductive substrate 1, and drying or curing for film formation. The thickness of the photosensitive layer 7 is about 0.1 to 50 μm.

The methods of manufacturing a photosensitive member according to the embodiments shown in FIGS. 1 and 2 are as mentioned above for the formation methods of the charge generating layer 2 and the charge transport layer 3. That is, by successively laminating an undercoat layer 5 as needed, a charge generating layer 2, and a charge transport layer 3 on an electroconductive substrate 1, a laminated function-separated type photosensitive member can be obtained.

The method of manufacturing a photoconductive member according to the embodiment shown in FIG. 3 is also as mentioned above for the formation method of the photosensitive layer 7. That is, by forming a photosensitive layer 7 on an electroconductive substrate 1, a single layer type photosensitive member can be obtained.

In either manufacturing method, when a drum is used as the electroconductive substrate 1 for forming the charge transport layer 3 or the photosensitive layer 7 with the dip coating method, the concentration of the binder resin in the coating liquid is about 7 to 13% by weight, preferably about 9 to 11% by weight. With a binder resin concentration of less than about 9% by weight, since the viscosity of the coating liquid is low, the pull-up rate of the drum needs to be higher for obtaining an even film thickness. With a binder resin concentration of less than 7% by weight, since the viscosity becomes further lower, it is difficult to have an even film thickness. With a concentration of over about 11% by weight, since the viscosity of the coating liquid is high, the pull-up rate of the drum needs to be lower for obtaining an even film thickness. With a concentration of over about 13% by weight, since an even film thickness cannot be obtained with a practical pull-up rate in the manufacturing process due to the high viscosity, it is not appropriate for the manufacture of a photosensitive member drum. Similarly, in the case the charge generating layer 2 is formed on a drum, the concentration of the binder resin in the coating liquid is preferably about 0.1 to 5% by weight. A concentration beyond the upper limit or the lower limit leads to the same result.

The feature of the invention is that an aliphatic unsaturated hydrocarbon is added and contained in the coating liquid for photosensitive member (solution or dispersion) for forming a layer of the photosensitive layer 4 or 7 (including the charge generating layer 2 and the charge transport layer 3) on the electroconductive substrate 1 for the stability (storage) of the coating liquid. It is preferable that the aliphatic unsaturated hydrocarbon to be added is a straight chain or a branched chain having 5 to 8 carbon atoms. In particular, an aliphatic unsaturated hydrocarbon having the boiling point in the range from about 30 to 120° C. is preferably used so that it can be eliminated easily by drying in the manufacturing process of the photosensitive member later described. With more than 8 carbon atoms, since the boiling point becomes higher, it is difficult to eliminate the aliphatic unsaturated hydrocarbon in the drying process. As a result, the aliphatic unsaturated hydrocarbon remains in the photosensitive member so that the electric characteristics of the photosensitive member are deteriorated such as the residual potential rise. With less than 5 carbon atoms, the boiling point is so low that the aliphatic unsaturated hydrocarbon becomes a gas in an ordinary temperature, and since handling and measuring become troublesome, it is not preferable. Concrete examples of aliphatic unsaturated hydrocarbons, satisfying the conditions include 1-pentene, 2-pentene, 2-methyl-2-butene, 1-hexene, 2-hexene, 1-heptene, 1-octene, and 1-nonyne. In particular, pentenes or hexenes having 5 to 6 carbon atoms are preferably used.

The amount of the aliphatic unsaturated hydrocarbon is preferably in the range of about 0.01 to 10 parts by weight based on the 100 parts by weight of the binder resin contained in the coating liquid composition. With an amount less than 0.01 part by weight, the effect of adding an aliphatic unsaturated hydrocarbon is small so that the residual potential rises. On the other hand, with an amount more than about 10 parts by weight, the amount of the aliphatic unsaturated hydrocarbon remained in the photosensitive member is large so that the electric characteristics such as the residual potential rise are deteriorated.

Although the mechanism of the effect of the aliphatic unsaturated hydrocarbon as an additive for stabilizing the coating liquid is not clearly known, it is considered that it scavenges radical active species generated by the deterioration by aging of the binder resin in the coating liquid (caused by light, oxygen, moisture or acid in the solvent, and the like)or restrains the generation of the radical active species. Since radical scavengers of conventional technologies remain in the photosensitive member after addition so that the problems including the residual potential rise are caused, the use thereof is not preferable.

Since the charge generating agent is dispersed in a solvent with a binder resin in the coating liquid composition for forming the charge generating layer, it has a small deterioration by aging compared with the coating liquid composition for forming the charge transport layer (the charge transport agent is dissolved in a solvent with a binder resin). Therefore, although the addition of the aliphatic unsaturated hydrocarbon is not essential in the former coating liquid composition, it is more preferable in the case a long term storage is expected. According to a preferable embodiment of a coating liquid composition for forming a charge transport layer, the composition comprises about 5 to 20% by weight of a charge transport agent, about 5 to 20% by weight of a binder resin and the remainder of a solvent, and further contains about 0.001 to 2% by weight of an aliphatic unsaturated hydrocarbon.

As an antioxidant, vitamin E, hydroquinone, hindered amine, hindered phenol, paraphenylene diamine, aryl alkane, a derivative thereof, an organic sulfur compound, or an organic phosphorus compound may be added in a coating liquid composition for a photosensitive member of the invention. However, since the antioxidants cause a problem of residual impurity in the photosensitive member, the amount needs to be the minimum level.

The method of manufacturing a photosensitive member of the invention preferably comprises a drying process of layers including the charge generating layer 2. The drying temperature of the photosensitive member is preferably about 30 to 120° C., particularly preferably about 80 to 100° C. With a drying temperature of the photosensitive member of lower than about 80° C., the drying time needs to be longer. In particular, with a drying temperature of lower than about 30° C., it is difficult to sufficiently dry the photosensitive member. On the other hand, with a drying temperature over about 100° C., the electric characteristics in the repeated use tend to be deteriorate. In particular, with a drying temperature of over about 120° C., an image obtained by the use of the photosensitive member is also deteriorated.

With a drying temperature in the range, the aliphatic unsaturated hydrocarbon added to the coating liquid composition can be completely eliminated in the drying process without remaining in the obtained photosensitive member. Further, since it is preferable to eliminate the solvent in the coating liquid composition in the drying process, the solvent to be used is preferably hydrocarbon halide as mentioned above.

Hereinafter embodiments of the invention will be further described with reference to examples and comparative examples. However, the invention is not limited thereto. "Part" denotes "part by weight" unless otherwise specified.

EXAMPLES

Among comparative examples described below, many are not the preferable embodiments of the invention. Although they are included in the range of the invention specified in the claims, they cannot perform the effects of the invention sufficiently compared with the preferred embodiments shown in examples.

Example 1 laminated type photosensitive member

Chemical formula 1

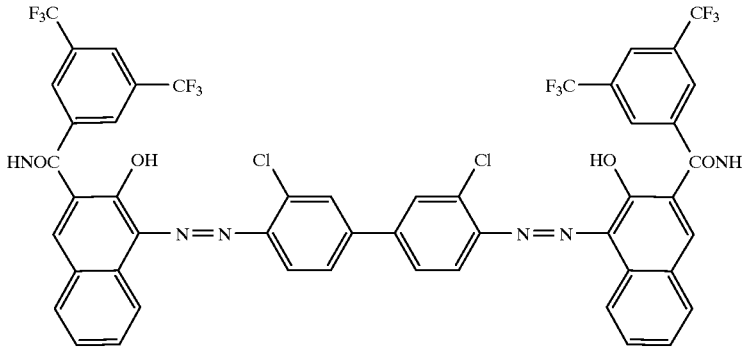

2 parts of a bis azo pigment represented by the chemical formula 1 as the charge generating agent, 1 part of phenoxy resin (PKHH: produced by Union Carbide Corp.), and 97 parts of 1,4-dioxane were dispersed with a ball mill dispersing device for 12 hours to prepare a dispersion. An aluminum cylindrical substrate (aluminum drum) having a 80 mm diameter and a 348 mm length was coated by soaking in a tank filled with the dispersion, pulling up, and drying at a room temperature for one hour so as to form a charge generating layer of about 1 $\mu$m thickness on the aluminum drum.

Chemical formula 2

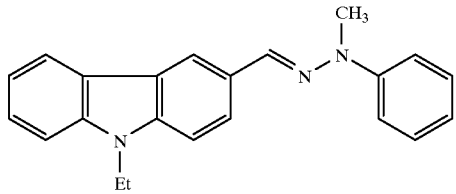

On the other hand, a coating liquid for a charge transport layer was prepared by dissolving 100 parts of a hydrazone compound represented by the chemical formula 2 as the charge transport agent, 100 parts of a polycarbonate resin having a viscosity-average molecular weight of 39,000 (Z-400: produced by Mitsubishi Gas Chemical Corp.) as the binder resin, and 0.1 part of 2-pentene as the additive in 800 parts of dichloromethane.

A laminated function-separated type photosensitive member sample A (0 day storage) was prepared by dip-coating the coating liquid for the charge transport layer to the charge generating layer formed as mentioned above, and drying at 80° C. for one hour so as to form a charge transport layer having about 20 μm thickness. Further, a photosensitive member sample B (120 days storage) was prepared in the same method, using the coating liquid for a charge transport layer after storing at a cool and dark place for 120 days. Both samples A, B had a homogeneous coat film without peel-off of the photosensitive layer.

Copying test was conducted with the samples A, B mounted in a commercially-available copying machine (SF-8870: produced by Sharp Corp.) and A4 size papers. In order to observe the photosensitive member surface potential at the developing part, specifically the charge potential, the photosensitive member surface potential in the dark excluding the exposing process (charge potential) $V_O$, the photosensitive member surface potential after eliminating the charge (residual potential) $V_R$, and the photosensitive member surface potential in the white portion at the time of exposing for examining the sensitivity $V_L$ were measured at the initial stage and after usage of 40,000 (40K) times. Results are shown in Table 1. With either sample, a clear image was obtained both in the initial stage and after repeated use. Further, change in the charge characteristics of the photosensitive member, such as the residual potential rise was not observed.

Example 2

In the process the same as example 1 except that 80 parts of a polycarbonate resin (C-1400: produced by Teijin Chemical Corp.) having a viscosity-average molecular weight of 38,000 as the binder resin, 20 parts of a polyester resin (V-290: produced by Toyobo Corp.) having a viscosity-average molecular weight of 22,000, and 0.1 part of 2-methyl-2-butene as the additive were used, photosensitive member samples A, B were produced and evaluated. A homogeneous coat film was formed without peel-off of the photosensitive layer. Results are shown in Table 1. With either sample A or B, a clear image was obtained both in the initial stage and after repeated use. Further, change in the charge characteristics of the photosensitive member, such as the residual potential rise was not observed.

Example 3

In the process the same as example 1 except that 90 parts of a polycarbonate resin (Z-400: produced by Mitsubishi Gas Chemical Corp.) having a viscosity-average molecular weight of 39,000 as the binder resin, 10 parts of a polyacrylate resin (U-100: produced by Unitika Corp.) having a viscosity-average molecular weight of 43,000, and 0.01 part of 1-octene as the additive were used, photosensitive member samples A, B were produced and evaluated. Results are shown in Table 1. With either sample A or B, a clear image was obtained in the initial stage. Although a slight residual potential rise was observed after repeated use, the image quality was not changed.

Example 4

In the process the same as example 1 except that 40 parts of a polycarbonate resin (C-1400: produced by Teijin Chemical Corp.) having a viscosity-average molecular weight of 38,000 as the binder resin, 40 parts of a polyarylate resin (U-100: produced by Unitika Corp.) having a viscosity-average molecular weight of 43,000, 20 parts of a polyester resin (V-290: produced by Toyobo Corp.) having a viscosity-average molecular weight of 21,000, and 1 part of 2-methyl-2-butene as the additive were used, photosensitive member samples A, B were produced and evaluated. Results are shown in Table 1. With either sample A or B, a homogeneous coat film was formed without peel-off of the photosensitive layer. A clear image was obtained both in the initial stage and after repeated use without change in the charge characteristics of the photosensitive member, such as the residual potential rise.

Example 5

In the process the same as example 1 except that 80 parts of a polycarbonate resin having a viscosity-average molecular weight of 45,000 synthesized by the copolymerization of 4,4'-(1-methyl ethylidene)bisphenol and 4,4'-(1-cyclo hexylidene)bisphenol by the ratio of 6:4 as the binder resin, 20 parts of a polyester resin (V-290: produced by Toyobo Corp.) having a viscosity-average molecular weight of 22,000, and 10 parts of 1-pentene as the additive were used, photosensitive member samples A, B were produced and evaluated. Results are shown in Table 1. With either sample A or B, a homogeneous coat film was formed without peel-off of the photosensitive layer. A clear image was obtained in the initial stage. Although a slight residual potential rise was observed after repeated use, the image quality was not changed.

Example 6

In the process the same as example 1 except that 85 parts of a polycarbonate resin (K-1300: produced by Teijin Chemical Corp.) having a viscosity-average molecular weight of 30,000 as the binder resin, 15 parts of a polycarbonate resin having a viscosity-average molecular weight of 45,000 synthesized by the copolymerization of 4,4'-(1-methyl ethylidene)bisphenol and 4,4'-(1-cyclo hexylidene) bisphenol by the ratio of 6:4, and 1 part of 2-pentene as the additive were used, photosensitive member samples A, B were produced and evaluated. Results are shown in Table 1. With either sample A or B, a homogeneous coat film was formed without peel-off of the photosensitive layer. A clear image was obtained both in the initial stage and after repeated use without change in the charge characteristics of the photosensitive member, such as the residual potential rise.

Example 7

In the process the same as example 1 except that 70 parts of a polycarbonate resin (Z-400: produced by Mitsubishi Gas Chemical Corp.) having a viscosity-average molecular weight of 39,000 as the binder resin, 10 parts of a polycarbonate resin having a viscosity-average molecular weight of 45,000 synthesized by the copolymerization of 4,4'-(1-methyl ethylidene)bisphenol and 4,4'-(1-cyclo hexylidene) bisphenol by the ratio of 6:4, 20 parts of a polyester resin (V-290: produced by Toyobo Corp.) having a viscosity-average molecular weight of 22,000, and 0.1 part of 1-pentene as the additive were used, photosensitive member samples A, B were produced and evaluated. Results are shown in Table 1. With either sample A or B, a homogeneous coat film was formed without peel-off of the photosensitive layer. A clear image was obtained both in the initial stage and after repeated use without change in the charge characteristics of the photosensitive member, such as the residual potential rise.

TABLE 1

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 1 | 2-pentene | A | −700 | −3 | −136 | −703 | −4 | −138 |
| | | B | −680 | −8 | −142 | −685 | −10 | −149 |
| 2 | 2-methyl-2-butene | A | −705 | −3 | −134 | −707 | −5 | −135 |
| | | B | −690 | −7 | −144 | −695 | −8 | −150 |
| 3 | 1-octene | A | −702 | −4 | −137 | −704 | −7 | −142 |
| | | B | −678 | −10 | −145 | −680 | −11 | −151 |
| 4 | 2-methyl-2-butene | A | −710 | −5 | −140 | −714 | −5 | −141 |
| | | B | −696 | −9 | −145 | −698 | −9 | −153 |
| 5 | 1-pentene | A | −702 | −3 | −134 | −702 | −3 | −138 |
| | | B | −677 | −7 | −138 | −680 | −12 | −147 |
| 6 | 2-pentene | A | −706 | −4 | −133 | −710 | −6 | −130 |
| | | B | −690 | −8 | −140 | −692 | −10 | −149 |
| 7 | 1-hexene | A | −701 | −5 | −132 | −705 | −5 | −133 |
| | | B | −683 | −9 | −142 | −684 | −12 | −151 |

Comparative Example 1

In the process the same as example 1 except that 2-pentene was not added, photosensitive member samples A, B were produced evaluated. Evaluation results are shown in Table 2. A clear image was obtained in the initial stage. However, after repeated use, white stripes were observed at the edge parts of the image. In the sample B, the residual potential rise was observed and the image density became extremely dense compared with the initial stage with fogging generated in the white part.

Comparative Example 2

In the process the same as example 2 except that 80 parts of a polycarbonate resin containing bisphenol A having a viscosity-average molecular weight of 100,000 as the binder resin and 20 parts of a polyester resin having a viscosity-average molecular weight of 18,000 were used, photosensitive member samples A, B were produced and evaluated. Evaluation results are shown in Table 2. Dots of undissolved components of the resin were observed on the photosensitive member from the initial stage, and black dots were formed on an image.

Comparative Example 3

In the process the same as example 3 except that 90 parts of a polycarbonate resin containing bisphenol A having a viscosity-average molecular weight of 100,000 as the binder resin and 10 parts of a polyarylate resin having a viscosity-average molecular weight of 28,000 were used, photosensitive member samples A, B were produced and evaluated. Evaluation results are shown in Table 2. Dots of undissolved components of the resin were observed on the photosensitive member from the initial stage, and black dots were formed on an image.

Comparative Example 4

In the process the same as example 3 except that 90 parts of a polycarbonate resin containing bisphenol A having a viscosity-average molecular weight of 25,000 as the binder resin and 10 parts of a polyarylate resin having a viscosity-average molecular weight of 55,000 were used, photosensitive member samples A, B were produced and evaluated. Evaluation results are shown in Table 2. A clear image was obtained in the initial stage, however, after repeated use, white stripes were observed at the edge parts of the image. In the sample B, the residual potential rise was observed and the image density became extremely dense compared with the initial stage with fogging generated in the white part.

Comparative Example 5

In the process the same as example 4 except that 40 parts of a polycarbonate resin containing bisphenol A having a viscosity-average molecular weight of 100,000 as the binder resin, 40 parts of a polyarylate resin having a viscosity-average molecular weight of 28,000 and 20 parts of a polyester resin having a viscosity-average molecular weight of 18,000 were used, photosensitive member samples A, B were produced and evaluated. Evaluation results are shown in Table 2. Dots of undissolved components of the resin were observed on the photosensitive member from the initial stage, and black dots were formed on an image.

Comparative Example 6

In the process the same as example 4 except that 40 parts of a polycarbonate resin containing bisphenol A having a viscosity-average molecular weight of 25,000 as the binder resin, 40 parts of a polyarylate resin having a viscosity-average molecular weight of 52,000 and 20 parts of a polyester resin having a viscosity-average molecular weight of 55,000 were used, photosensitive member samples A, B were produced and evaluated. Evaluation results are shown in Table 2. Dots of undissolved components of the resin were observed on the photosensitive member from the initial stage, and black dots were formed on an image.

Comparative Example 7

In the process the same as example 5 except that 20 parts of a polyester resin having a viscosity-average molecular weight of 55,000 were used as the binder resin, photosensitive member samples A, B were produced and evaluated. Evaluation results are shown in Table 2. Dots of undissolved components of the resin were observed on the photosensitive member from the initial stage, and black dots were formed on an image.

Comparative Examples 8, 9

In the process the same as examples 6, 7 except that unsaturated hydrocarbon compounds shown in Table 2 were used, photosensitive member samples A, B were produced and evaluated. Evaluation results are shown in Table 2.

TABLE 2

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 1 | No addition | A | −703 | −3 | −136 | −710 | −6 | −139 |
| | | B | −600 | −100 | −246 | −502 | −150 | −300 |
| 2 | 2-methyl-2-butene | A | −706 | −3 | −134 | −639 | −48 | −185 |
| | | B | −675 | −12 | −148 | −610 | −55 | −193 |
| 3 | 1-octene | A | −702 | −4 | −137 | −638 | −51 | −187 |
| | | B | −670 | −11 | −145 | −612 | −61 | −195 |
| 4 | 1-octene | A | −711 | −5 | −140 | −643 | −55 | −190 |
| | | B | −685 | −19 | −150 | −621 | −69 | −200 |
| 5 | 2-methyl-2-butene | A | −705 | −3 | −134 | −621 | −50 | −188 |
| | | B | −680 | −15 | −141 | −610 | −55 | −196 |
| 6 | 2-methyl-2-butene | A | −700 | −12 | −134 | −628 | −52 | −186 |
| | | B | −681 | −22 | −148 | −610 | −60 | −193 |
| 7 | 1-pentene | A | −684 | −10 | −130 | −631 | −48 | −183 |
| | | B | −670 | −25 | −155 | −605 | −65 | −199 |
| 8 | 2-butene | A | −710 | −4 | −133 | −712 | −5 | −134 |
| | | B | −590 | −106 | −241 | −489 | −167 | −301 |
| 9 | 1-nonyne | A | −702 | −5 | −132 | −700 | −7 | −167 |
| | | B | −585 | −120 | −248 | −500 | −170 | −299 |

Example 8 single layer type photosensitive member

Chemical formula 3

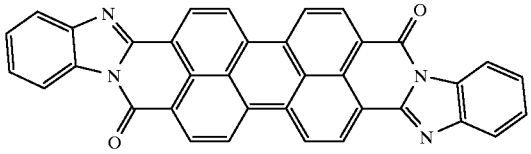

2 parts of a perylene pigment represented by the chemical formula 3 as the charge generating agent and 98 parts of 1,2-dichloro ethane were dispersed with a paint shaker to prepare a dispersion.

Chemical formula 4

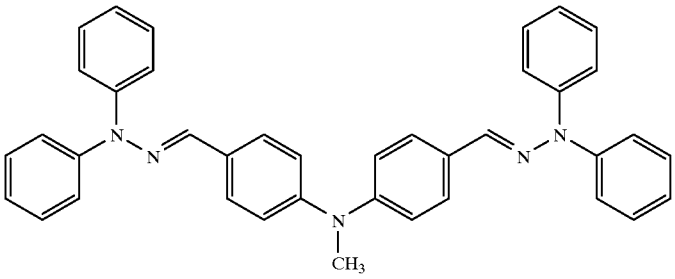

On the other hand, a coating liquid for a photosensitive member was prepared by dissolving 100 parts of a hydrazone compound represented by the chemical formula 4 as the charge transport agent, 80 parts of a polycarbonate resin having a viscosity-average molecular weight of 39,000 (Z-400: produced by Mitsubishi Gas Chemical Corp.) as the binder, 20 parts of a polyester resin (V-290: produced by Toyobo Corp.) having a viscosity-average molecular weight of 22,000, and 1 part of 2-methyl-2-butene as the additive in 700 parts of dichloromethane, and adding the solution to the dispersion. A single layer type photosensitive member sample A (0 day storage) was prepared by dip-coating the coating liquid to an aluminum cylindrical substrate, and drying at 100° C. for one hour so as to form a photosensitive layer having about 15 μm thickness. Further, a photosensitive member sample B (120 days storage) was prepared in the same method, using the coating liquid after storing at a cool and dark place for 120 days. Both samples A, B had a homogeneous coat film without peel-off of the photosensitive layer.

Copying test was conducted with the samples A, B mounted in a testing device produced by modifying a commercially-available copying machine (SF-8870: produced by Sharp Corp.) for positive charge so as to evaluate as in example 1. Results are shown in Table 3. With either sample, a clear image was obtained both in the initial stage and after repeated use. Besides, sensitivity decline caused by the film thickness reduction by wearing was hardly observed.

Example 9

In the process the same as example 8 except that 80 parts of a polycarbonate resin (C-1400: produced by Teijin Chemical Corp.) having a viscosity-average molecular weight of 38,000 as the binder resin, 20 parts of a polyester resin (V-290: produced by Toyobo Corp.) having a viscosity-average molecular weight of 22,000, and 0.1 part of 2-methyl-2-butene as the additive were used, photosensitive member samples A, B were produced and evaluated. Evaluation results are shown in Table 3. A homogeneous coat film was formed without peel-off of the photosensitive layer. A clear image was obtained both in the initial stage and after repeated use. Further, change in the charge characteristics of the photosensitive member, such as the residual potential rise was not observed.

Example 10

In the process the same as example 8 except that 90 parts of a polycarbonate resin (Z-400: produced by Mitsubishi Gas Chemical Corp.) having a viscosity-average molecular weight of 39,000 as the binder resin, 10 parts of a polyarylate resin (U-100: produced by Unitika Corp.) having a viscosity-average molecular weight of 43,000, and 0.01 part of 1-octene as the additive were used, photosensitive member samples A, B were produced and evaluated. Evaluation results are shown in Table 3. With either sample A or B, a clear image was obtained in the initial stage. Although a slight residual potential rise was observed after repeated use, the image quality was not changed.

Example 11

In the process the same as example 8 except that 40 parts of a polycarbonate resin (C-1400: produced by Teijin Chemical Corp.) having a viscosity-average molecular weight of 38,000 as the binder resin, 40 parts of a polyarylate resin (U-100: produced by Unitika Corp.) having a viscosity-average molecular weight of 43,000, 20 parts of a polyester resin (V-290: produced by Toyobo Corp.) having a viscosity-average molecular weight of 21,000, and 1 part of 2-pentene as the additive were used, photosensitive member samples A, B were produced and evaluated. Results are shown in Table 3. With either sample A or B, a homogeneous coat film was formed without peel-off of the photosensitive layer. A clear image was obtained both in the initial stage and after repeated use without change in the charge characteristics of the photosensitive member, such as the residual potential rise.

Example 12

In the process the same as example 8 except that 80 parts of a polycarbonate resin having a viscosity-average molecular weight of 45,000 synthesized by the copolymerization of 4,4'-(1-methyl ethylidene)bisphenol and 4,4'-(1-cyclo hexylidene)bisphenol by the ratio of 6:4 as the binder resin, 20 parts of a polyester resin (V-290: produced by Toyobo Corp.) having a viscosity-average molecular weight of 22,000, and 10 parts of 1-hexene as the additive were used, photosensitive member samples A, B were produced and evaluated. Evaluation results are shown in Table 3. With either sample A or B, a homogeneous coat film was formed without peel-off of the photosensitive layer. A clear image was obtained in the initial stage. Although a slight residual potential rise was observed after repeated use, the image quality was not changed.

Example 13

In the process the same as example 8 except that 85 parts of a polycarbonate resin (K-1300: produced by Teijin Chemical Corp.) having a viscosity-average molecular weight of 30,000 as the binder resin, 15 parts of a polycarbonate resin having a viscosity-average molecular weight of 45,000 synthesized by the copolymerization of 4,4'-(1-methyl ethylidene)bisphenol and 4,4'-(1-cyclo hexylidene) bisphenol by the ratio of 6:4, and 1 part of 1-pentene as the additive were used, photosensitive member samples A, B were produced and evaluated. Evaluation results are shown in Table 3. With either sample A or B, a homogeneous coat film was formed without peel-off of the photosensitive layer. A clear image was obtained both in the initial stage and after repeated use without change in the charge characteristics of the photosensitive member, such as the residual potential rise.

Example 14

In the process the same as example 8 except that 70 parts of a polycarbonate resin (Z-400: produced by Mitsubishi Gas Chemical Corp.) having a viscosity-average molecular weight of 39,000 as the binder resin, 10 parts of a polycarbonate resin having a viscosity-average molecular weight of 45,000 synthesized by the copolymerization of 4,4'-(1-methyl ethylidene)bisphenol and 4,4'-(1-cyclo hexylidene) bisphenol by the ratio of 6:4, 20 parts of a polyester resin (V-290: produced by Toyobo Corp.) having a viscosity-average molecular weight of 22,000, and 0.1 part of 2-hexene as the additive were used, photosensitive member samples A, B were produced and evaluated. Evaluation results are shown in Table 3. With either sample A or B, a homogeneous coat film was formed without peel-off of the photosensitive layer. A clear image was obtained both in the initial stage and after repeated use without change in the charge characteristics of the photosensitive member, such as the residual potential rise.

TABLE 3

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 8 | 2-methyl-2-butene | A | 702 | 35 | 142 | 685 | 50 | 144 |
| | | B | 679 | 45 | 145 | 662 | 61 | 147 |
| 9 | 2-methyl-2-butene | A | 710 | 40 | 138 | 680 | 51 | 140 |
| | | B | 696 | 45 | 140 | 666 | 60 | 144 |
| 10 | 1-octene | A | 705 | 38 | 144 | 687 | 49 | 148 |
| | | B | 690 | 46 | 144 | 677 | 60 | 148 |
| 11 | 2-pentene | A | 702 | 40 | 146 | 681 | 50 | 150 |
| | | B | 685 | 44 | 149 | 664 | 56 | 155 |
| 12 | 1-hexene | A | 700 | 38 | 138 | 680 | 49 | 142 |
| | | B | 690 | 42 | 140 | 672 | 61 | 144 |
| 13 | 1-pentene | A | 704 | 44 | 141 | 682 | 55 | 145 |
| | | B | 688 | 49 | 144 | 671 | 59 | 150 |
| 14 | 2-hexene | A | 710 | 45 | 143 | 689 | 58 | 147 |
| | | B | 679 | 49 | 145 | 664 | 65 | 152 |

Comparative Example 10

In the process the same as example 8 except that 2-methyl-2-butene was not added, photosensitive member samples A, B were produced and evaluated. Evaluation results are shown in Table 4. A clear image was obtained in the initial stage. However, after repeated use, white stripes were observed at the edge parts of the image. In the sample B, the residual potential rise was observed and the image density became extremely dense compared with the initial stage with fogging generated in the white part.

Comparative Examples 11 to 16

In the process the same as examples 9 to 14 except that an unsaturated hydrocarbon compound was not added, photosensitive member samples A, B were produced and evaluated.

Evaluation results are shown in Table 4.

TABLE 4

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 10 | No addition | A | 700 | 37 | 144 | 675 | 60 | 170 |
| | | B | 550 | 145 | 230 | 500 | 201 | 255 |
| 11 | No addition | A | 709 | 42 | 140 | 677 | 53 | 144 |
| | | B | 548 | 144 | 234 | 502 | 205 | 253 |

TABLE 4-continued

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 12 | No addition | A | 703 | 36 | 142 | 688 | 50 | 149 |
| | | B | 538 | 146 | 244 | 500 | 203 | 248 |
| 13 | No addition | A | 700 | 43 | 144 | 680 | 49 | 152 |
| | | B | 533 | 146 | 248 | 503 | 205 | 252 |
| 14 | No addition | A | 702 | 37 | 136 | 681 | 47 | 140 |
| | | B | 492 | 152 | 252 | 450 | 211 | 255 |
| 15 | No addition | A | 702 | 43 | 144 | 681 | 58 | 144 |
| | | B | 502 | 151 | 253 | 477 | 203 | 260 |
| 16 | No addition | A | 708 | 44 | 142 | 688 | 55 | 143 |
| | | B | 489 | 155 | 256 | 457 | 221 | 266 |

Comparative Example 15 laminated type photosensitive comprising an undercoat layer 6 parts of a copolymer nylon (Amiran CM8000: produced by Toray Corp.) was dissolved in a solvent mixture of 47 parts of methyl alcohol and 47 parts of chloroform. An aluminum cylindrical substrate (aluminum drum) having a 30 mm diameter and a 255 mm length was coated by soaking in a tank filled with the solution, pulling up, and drying at 110° C. for 10 minutes so as to form an undercoat layer of about 2 μm thickness on the aluminum drum.

Chemical formula 5

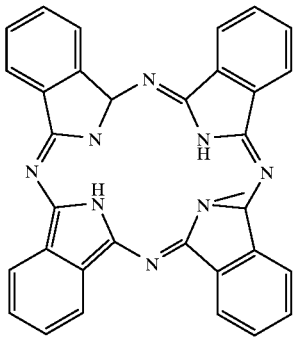

2 parts of an X type nonmetallic phthalocyanine represented by the chemical formula 5 as the charge generating agent, 1 part of a polyvinyl butylal resin (Esrec BMS: produced by Sekisui Chemical Corp.), and 97 parts of dichloroethane were dispersed with a ball mill dispersing device for 12 hours to prepare a dispersion. The aluminum cylindrical substrate having the undercoat layer was coated by soaking in a tank filled with the dispersion, pulling up, and drying at a room temperature for one hour so as to form a charge generating layer of about 0.2 μm thickness on the undercoat layer.

Chemical formula 6

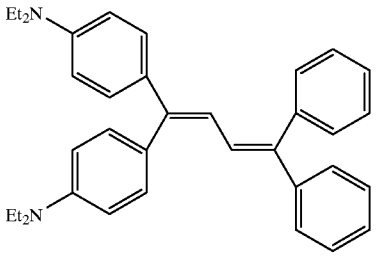

On the other hand, a coating liquid for a charge transport layer was prepared by dissolving 100 parts of a styryl compound represented by the chemical formula 6 as the charge transport agent, 80 parts of a polycarbonate resin having a viscosity-average molecular weight of 30,000 (K-1300: produced by Teijin Chemical Corp.) as the binder resin, 20 parts of a polyester resin having a viscosity-average molecular weight of 29,000 (V-103: produced by Toyobo Corp.) and 0.5 part of 2-pentene as the additive in 800 parts of chloroform. A laminated function-separated type photosensitive member having an under coat layer sample A (0 day storage) was prepared by dip-coating the coating liquid for the charge transport layer to the charge generating layer formed as mentioned above, and drying at 100° C. for one hour so as to form a charge transport layer having about 20 μm thickness. Further, a photosensitive member sample B (120 days storage) was prepared in the same method, using the coating liquid for a charge transport layer after storing at a cool and dark place for 120 days. Both samples A, B had a homogeneous coat film without peel-off of the photosensitive layer.

Copying test was conducted with the samples A, B mounted in a commercially-available laser beam printer (JX9500: produced by Sharp Corp.) and A4 size papers. The charge potentials were measured as in example 1. Results are shown in Table 5. With either sample A, B, a clear image was obtained both in the initial stage and after repeated use. Further, change in the charge characteristics of the photosensitive member, such as the residual potential rise was hardly observed even in the sample B, nor sensitivity decline derived from the film thickness decrease by wearing.

TABLE 5

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 15 | 2-pentene | A | −710 | −8 | −133 | −705 | −10 | −138 |
| | | B | −700 | −10 | −136 | −688 | −13 | −140 |

Comparative Example 17

In the process the same as example 15 except that 2-pentene was not added, photosensitive member samples A, B were produced and evaluated. Results are shown in Table 6.

TABLE 6

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 17 | No addition | A | −707 | −8 | −135 | −704 | −11 | −138 |
| | | B | −550 | −120 | −241 | −502 | −155 | −288 |

Example 16 sheet type photosensitive member

Chemical formula 3

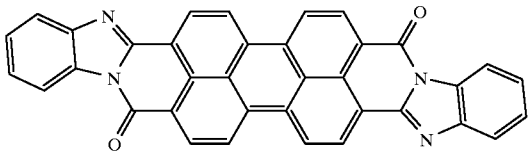

2 parts of a perylene pigment represented by the chemical formula 3 as the charge generating agent, 1 part of a phenoxy resin (PKHH: produced by Union Carbide Corp.) and 97 parts of 1,4-dioxane were dispersed with a ball mill dispersing device for 12 hours to prepare a dispersion. An electroconductive substrate where an aluminum layer is formed on the surface of polyethylene terephthalate by the deposition method is applied with the dispersion with an applicator, dried at a room temperature so as to form a charge generating layer having about 1 μm thickness.

Chemical formula 7

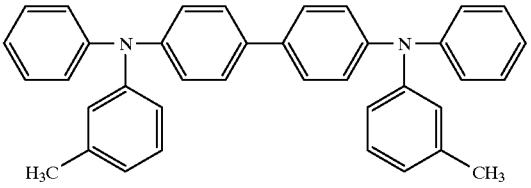

On the other hand, a coating liquid for a charge transport layer was prepared by dissolving 100 parts of a triphenyl amine compound represented by the chemical formula 7 as the charge transport agent, 80 parts of a polycarbonate resin having a viscosity-average molecular weight of 43,000 produced by the copolymerization of 4,4'-(1-methyl ethylidene)bis[2-methyl phenol] and 4,4'-(1-cyclo hexylidene)bisphenol by the ratio of 51:49 as the binder, 20 parts of a polyester resin (V-290: produced by Toyobo Corp.) having a viscosity-average molecular weight of 22,000, 1 part of 1-heptene as the additive, and 0.02 part of dimethyl silicone oil (SH200 50cs: produced by Toray Silicone Corp.) as the surface improving agent in 800 parts of dichloromethane. A sheet type photosensitive member sample A (0 day storage) was prepared by coating the coating liquid for coating the charge transport layer to the charge generating layer formed as mentioned above with an applicator, and drying at 80° C. for one hour so as to form a charge transport layer having about 25 μm thickness. Further, a photosensitive member sample B (120 days storage) was prepared in the same method, using the coating liquid for a charge transport layer after storing at a cool and dark place for 120 days. Both samples A, B had a homogeneous coat film without peel-off of the photosensitive layer.

The samples A, B attached on an aluminum cylindrical substrate having an 80 mm diameter and a 348 mm length with an electroconductive tape were mounted in a commercially-available copying machine (SF-8870: produced by Sharp Corp.) and evaluated as in example 1. Evaluation results are shown in Table 7. With either sample A or B, a clear image was obtained both in the initial stage and after repeated use. Further, sensitivity decline derived from the film thickness decrease by wearing was hardly observed.

TABLE 7

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 16 | 1-heptene | A | −702 | −4 | −133 | −704 | −5 | −136 |
| | | B | −698 | −12 | −136 | −700 | −14 | −142 |

Comparative Example 18

In the process the same as example 16 except that 15 parts of 1-heptene was used, photosensitive member samples A, B were produced and evaluated. Evaluation results are shown in Table 8.

TABLE 8

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 18 | 1-heptene | A | −700 | −3 | −135 | −707 | −5 | −136 |
| | | B | −502 | −149 | −233 | −490 | −188 | −255 |

Example 17 single type photosensitive member comprising an undercoat layer 6 parts of a methoxy methylated nylon (EF-30T: produced by Teikoku Chemical Corp.) was dissolved in a solvent mixture of 47 parts of methyl alcohol and 47 parts of 1,2-dichloro ethane. An aluminum cylindrical substrate (aluminum drum) having an 80 mm diameter and a 348 mm length was coated by soaking in a tank filled with the solution, pulling up, and drying at 110° C. for 10 minutes so as to form an undercoat layer of about 1 μm thickness on the aluminum drum.

Chemical formula 3

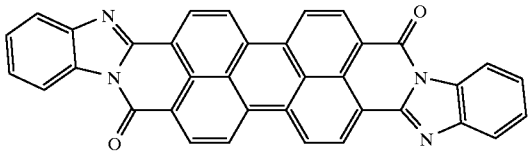

2 parts of a perylene pigment represented by the chemical formula 3 as the charge generating agent and 98 parts of 1,2-dichloroethane were dispersed with a paint shaker to prepare a dispersion.

Chemical formula 4

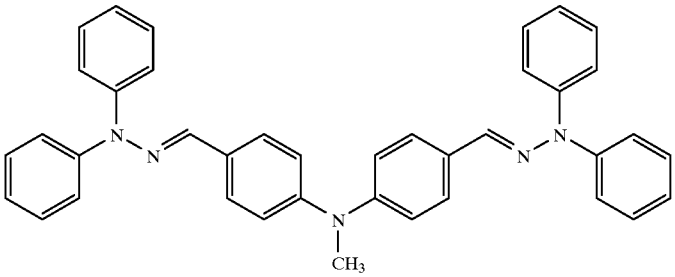

A coating liquid for a photosensitive layer was prepared by dissolving 100 parts of a hydrazone compound represented by the chemical formula 4 as the charge transport agent, 80 parts of a polycarbonate resin having a viscosity-average molecular weight of 39,000 (Z-400: produced by Mitsubishi Gas Chemical Corp.) as the binder, 20 parts of a polyester resin having a viscosity-average molecular weight of 22,000 (V-290: produced by Toyobo Corp.) and 0.1 part of 1-octene as the additive in 700 parts of dichloro methane, and adding the solution to the dispersion. A sheet type photosensitive member having an undercoat layer sample A (0 day storage) was prepared by dip-coating the coating liquid to the aluminum drum having the undercoat layer, and drying at 100° C. for one hour so as to form a photosensitive layer having about 15 $\mu$m thickness. Further, a photosensitive member sample B (120 days storage) was prepared in the same method, using the coating liquid after storing at a cool and dark place for 120 days. Both samples A, B had a homogeneous coat film without peel-off of the photosensitive layer.

Copying test was conducted with the samples A, B mounted in a testing device produced by modifying a commercially-available copying machine (SF-8870: produced by Sharp Corp.) for positive charge so as to evaluate as in example 1. Results are shown in Table 9. A clear image was obtained both in the initial stage and after repeated use. Besides, sensitivity decline caused by the film thickness reduction by wearing was hardly observed.

TABLE 9

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 17 | 1-octene | A | −699 | −7 | −136 | −701 | −7 | −137 |
| | | B | −696 | −10 | −133 | −699 | −10 | −135 |

Comparative Example 19

In the process the same as example 17 except that 1-octene was not added, photosensitive member samples A, B were produced and evaluated. Results are shown in Table 10.

TABLE 10

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 19 | No addition | A | −697 | −7 | −134 | −702 | −9 | −137 |
| | | B | −500 | −145 | −252 | −497 | −160 | −261 |

Example 18 laminated type photosensitive member comprising an undercoat layer 6 parts of a methoxy methylated nylon (EF-30T: produced by Teikoku Chemical Corp.) was dissolved in a solvent mixture of 47 parts of methyl alcohol and 47 parts of 1,2-dichloro ethane. An aluminum cylindrical substrate (aluminum drum) having an 80 mm diameter and a 348 mm length was dip-coated by soaking in a tank filled with the solution, pulling up, and drying at 110° C. for 10 minutes so as to form an undercoat layer of about 1 μm thickness on the aluminum drum.

Chemical formula 8

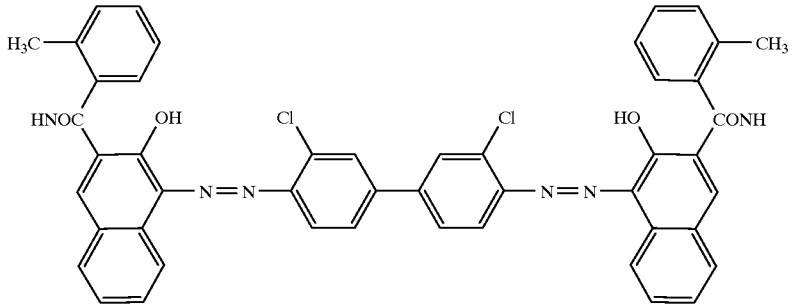

2 parts of a bis azo pigment represented by the chemical formula 8 as the charge generating agent, 1 part of an epoxy resin (Rikaregin BPO-20E: produced by Shin Nihon Rika Corp.), and 97 parts of dimethoxy ethane were dispersed with a paint shaker for 6 hours to prepare a dispersion. The aluminum drum having the undercoat layer was coated by soaking in a tank filled with the dispersion, pulling up, and drying at a room temperature for one hour so as to form a charge generating layer of about 0.2 μm thickness on the undercoat layer.

Chemical formula 9

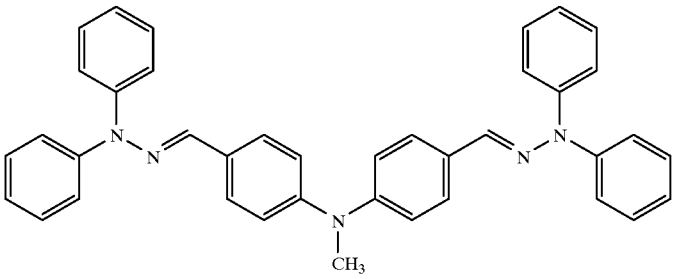

On the other hand, a coating liquid for a charge transport layer was prepared by dissolving 100 parts of a bishydrazone compound represented by the chemical formula 9 as the charge transport agent, 90 parts of a polycarbonate resin having a viscosity-average molecular weight of 38,000 (C-1400: produced by Teijin Chemical Corp.) as the binder resin, 10 parts of a polyester resin having a viscosity-average molecular weight of 22,000 (V-290: produced by Toyobo Corp.) and 1 part of 2-methyl-2-butene as the additive in 800 parts of dichloromethane. A laminated function-separated type photosensitive member sample A (0 day storage) was prepared by dip-coating the coating liquid for the charge transport layer to the charge generating layer formed as mentioned above, and drying at 80° C. for one hour so as to form a charge transport layer having about 25 μm thickness Further, a photosensitive member sample B (120 days storage) was prepared in the same method, using the coating liquid for a charge transport layer after storing at a cool and dark place for 120 days. Both samples A, B had a homogeneous coat film without peel-off of the photosensitive layer.

The samples A, B were evaluated as in example 1. Results are shown in Table 11. A clear image was obtained both in the initial stage and after repeated use. Besides, sensitivity decline caused by the film thickness reduction by wearing was hardly observed even in a high temperature and high humidity condition.

Example 19

In the process the same as example 18 except that 600 parts of dichloro methane was used for a coating liquid for a charge transport layer, photosensitive member samples A, B were produced and evaluated. Results are shown in Table 11.

Although the coating liquid was highly viscous, a homogeneous film thickness was obtained with a slow pull-up rate.

Example 20

In the process the same as example 18 except that 1000 parts of dichloro methane was used for a coating liquid for a charge transport layer, photosensitive member samples A, B were produced and evaluated. Results are shown in Table 11.

TABLE 11

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 18 | 2-methyl-2-butene | A | −710 | −5 | −138 | −711 | −7 | −137 |
| | | B | −700 | −11 | −124 | −702 | −18 | −147 |
| 19 | 2-methyl-2-butene | A | −708 | −6 | −137 | −708 | −9 | −138 |
| | | B | −701 | −9 | −144 | −704 | −15 | −148 |
| 20 | 2-methyl-2-butene | A | −712 | −8 | −141 | −712 | −8 | −143 |
| | | B | −699 | −11 | −150 | −704 | −13 | −151 |

Comparative Example 20

In the process the same as example 18 except that 500 parts of dichloro methane was used for a coating liquid for a charge transport layer, photosensitive member samples A, B were produced and evaluated. Results are shown in Table 12.

The coating liquid was highly viscous so that a homogeneous film thickness was not obtained. Density irregularity was observed on the entire image.

Comparative Example 21

In the process the same as example 18 except that 1100 parts of dichloro methane was used for a coating liquid for a charge transport layer, photosensitive member samples A, B were produced and evaluated. Results are shown in Table 12.

The coating liquid had an extremely low viscosity so that a homogeneous film thickness was not obtained. Only a charge transport layer having about 10 $\mu$m thickness was obtained.

TABLE 12

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 20 | 2-methyl-2-butene | A | −705 | −8 | −133 | −704 | −14 | −138 |
| | | B | −489 | −163 | −253 | −489 | −188 | −264 |
| 21 | 2-methyl-2-butene | A | −660 | −45 | −170 | −640 | −150 | −250 |
| | | B | −507 | −50 | −255 | −460 | −208 | −264 |

Example 21

In the process the same as example 18 except that the charge transport layer was dried after coating at 30° C. for 7 days, photosensitive member samples A, B were produced and evaluated. Results are shown in Table 13.

Example 22

In the process the same as example 18 except that the charge transport layer was dried after coating at 120° C., photosensitive member samples A, B were produced and evaluated. Results are shown in Table 13.

TABLE 13

| Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 21 | 2-methyl-2-butene | A | −695 | −30 | −139 | −705 | −48 | −149 |
| | | B | −688 | −10 | −142 | −700 | −22 | −145 |
| 22 | 2-methyl-2-butene | A | −700 | −35 | −150 | −704 | −40 | −166 |
| | | B | −685 | −50 | −149 | −697 | −55 | −168 |

Comparative Example 22

In the process the same as example 18 except that the charge transport layer was dried after coating at 25° C. for 7 days, photosensitive member samples A, B were produced and evaluated. Results are shown in Table 14.

Comparative Example 23

In the process the same as example 18 except that the charge transport layer was dried after coating at 130° C., photosensitive member samples A, B were produced and evaluated. Results are shown in Table 14.

TABLE 14

| Comparative Example | Unsaturated Hydrocarbon Compound | Sample | Initial (V) $V_0$ | Initial (V) $V_R$ | Initial (V) $V_L$ | after 40K (V) $V_0$ | after 40K (V) $V_R$ | after 40K (V) $V_L$ |
|---|---|---|---|---|---|---|---|---|
| 22 | 2-methyl-2-butene | A | −650 | −40 | −130 | −600 | −120 | −142 |
| | | B | −645 | −40 | −125 | −605 | −135 | −135 |
| 23 | 2-methyl-2-buitene | A | −555 | −10 | −220 | −550 | −20 | −360 |
| | | B | −540 | −15 | −210 | −530 | −25 | −380 |

As heretofore mentioned, the samples A, B of the examples substantially maintain the initial value in terms of the charge potential, the residual potential and the photosensitive member surface potential even after usage. Whereas the samples B of the comparative examples had a remarkable deviation from the initial value, in particular, a significant residual potential rise was observed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A coating liquid composition for a photosensitive member for electrophotography comprising an organic photoconductive compound and a binder resin which are dissolved or dispersed in a solvent, containing an aliphatic unsaturated hydrocarbon having 5 to 8 carbon atoms and a boiling point in a range from 30 to 120° C.

2. The coating liquid composition for a photosensitive member for electrophotography of claim 1, wherein the organic photoconductive compound is a charge generating agent and/or a charge transport agent.

3. A coating liquid composition for a charge transport layer for a photosensitive member for electrophotography containing 5 to 20% by weight of a charge transport layer organic photoconductive compound, 5 to 20% by weight of a binder and a solvent for the remainder, further containing 0.001 to 2% by weight of an aliphatic unsaturated hydrocarbon having 5 to 8 carbon atoms and a boiling point in a range from 30 to 120° C.

4. The coating liquid composition for a charge transport layer for a photosensitive member for electrophotography of claim 3, wherein the charge transport layer organic photoconductive compound is selected from the group consisting of a hydrazone compound, a styryl compound, and a triphenyl amine compound.

5. The coating liquid composition for a photosensitive member for electrophotography of claim 1, wherein the aliphatic unsaturated hydrocarbon in a range from 0.01 to 10 parts by weight to 100 parts by weight of the binder resin is contained in the composition.

6. The coating liquid composition for a photosensitive member for electrophotography of claim 1, wherein the binder resin is a polycarbonate resin.

7. The coating liquid composition for a photosensitive member for electrophotography of claim 1, wherein the binder resin is a mixture of a polycarbonate resin and a polyester resin.

8. The coating liquid composition for a photosensitive member for electrophotography of claim 1, wherein the binder resin is a mixture of a polycarbonate resin, and a polyester resin and/or a polyarylate resin.

9. The coating liquid composition for a photosensitive member for electrophotography of claim 6, wherein the viscosity-average molecular weight of the polycarbonate resin is within a range of 30,000 to 60,000.

10. The coating liquid composition for a photosensitive member for electrophotography of claim 7, wherein the viscosity-average molecular weight of the polyester resin is within a range of 20,000 to 50,000.

11. The coating liquid composition for a photosensitive member for electrophotography of claim 8, wherein the viscosity-average molecular weight of the polyarylate resin is within a range of 30,000 to 50,000.

12. The coating liquid composition for a photosensitive member for electrophotography of claim 1, wherein the solvent is a hydrocarbon halide.

13. A method of manufacturing a laminated function-separated photosensitive member for electrophotography comprising the steps of:

(a) applying a coating liquid for a charge generating layer on an electroconductive substrate, which may have an undercoat layer thereon, of forming a charge generating layer, and (b) applying a coating liquid for a charge transport layer on the charge generating layer for forming a charge transport layer, wherein the coating liquid for the charge generating layer contains a charge generating organic photoconductive compound and a binder resin dispersed in a solvent, and the coating liquid for a charge transport layer contains a charge transport organic photoconductive compound and a binder resin dissolved in a solvent, and further an aliphatic unsaturated hydrocarbon having 5 to 8 carbon atoms and a boiling point in a range from 30 to 120° C.

14. The method of manufacturing a laminated function-separated photosensitive member for electrophotography of claim 13, wherein the coating liquid for a charge generating layer contains an aliphatic unsaturated hydrocarbon having 5 to 8 carbon atoms and a boiling point in a range from 30 to 120° C.

15. The method of manufacturing a laminated function-separated photosensitive member for electrophotography of claim 13, wherein the concentration of the binder resin in the coating liquid for a charge generating layer is within a range of 0.1 to 5% by weight.

16. The method of manufacturing a laminated function-separated photosensitive member for electrophotography of claim 13, wherein the concentration of the binder resin in the coating liquid for a charge transport layer is within a range of 7 to 13% by weight.

17. The method of manufacturing a laminated function-separated photosensitive member for electrophotography of claim 13, further comprising the step of drying the formed charge generating layer and/or charge transport layer at 30 to 120° C. after said step (a) and/or step (b).

18. A method of manufacturing a single layer photosensitive member for electrophotography comprising the steps of:

applying a coating liquid for the photosensitive layer on an electroconductive substrate, which may have an undercoat layer thereon, for forming a photosensitive layer, wherein the coating liquid for a photosensitive layer contains a charge generating organic photoconductive compound, a charge transport organic photoconductive compound and a binder resin dissolved or dispersed in a solvent, and further an aliphatic unsaturated hydrocarbon having 5 to 8 carbon atoms and a boiling point in a range from 30 to 120° C.

19. The method of manufacturing a single layer photosensitive member for electrophotography of claim 18, wherein the concentration of the binder resin in the coating liquid for a photosensitive layer is within a range of 7 to 13% by weight.

20. The method of manufacturing a single layer photosensitive member for electrophotography of claim 18, further comprising the step of drying the photosensitive layer at 30 to 120° C. after the step of forming a photosensitive layer.

* * * * *